US006375506B1

(12) United States Patent
Saunders et al.

(10) Patent No.: US 6,375,506 B1
(45) Date of Patent: Apr. 23, 2002

(54) HIGH-DENSITY HIGH-SPEED INPUT/ OUTPUT CONNECTOR

(75) Inventors: Barbara D. Saunders, Byhalia, MS (US); Steven W. Knoernschild, Maumelle, AR (US); Hesham K. Elkhatib, Memphis, TN (US)

(73) Assignee: Tyco Electronics Logistics A.G., Steinach (CH)

( * ) Notice: Subject to any disclaimer, the term of this patent is extended or adjusted under 35 U.S.C. 154(b) by 0 days.

(21) Appl. No.: 09/692,840

(22) Filed: Oct. 19, 2000

Related U.S. Application Data

(60) Provisional application No. 60/160,442, filed on Oct. 19, 1999.

(51) Int. Cl.[7] ..... H01R 13/648
(52) U.S. Cl. ..... 439/607; 439/608; 439/79
(58) Field of Search ..... 439/607, 608, 439/609, 610, 80, 81, 79

(56) References Cited

U.S. PATENT DOCUMENTS

| | | | | |
|---|---|---|---|---|
| 4,869,676 | A | | 9/1989 | Demler, Jr. et al. |
| 4,881,905 | A | | 11/1989 | Demler, Jr. et al. |
| 4,914,062 | A | | 4/1990 | Voltz |
| 4,939,624 | A | | 7/1990 | August et al. |
| 5,055,069 | A | | 10/1991 | Townsend et al. |
| 5,133,679 | A | | 7/1992 | Fusselman et al. |
| 5,135,405 | A | | 8/1992 | Fusselman et al. |
| 5,342,211 | A | | 8/1994 | Broeksteeg |
| 5,564,949 | A | * | 10/1996 | Wellinsky ..... 439/607 |
| 5,584,727 | A | | 12/1996 | Miller et al. |
| 5,639,263 | A | | 6/1997 | Zell et al. |
| 5,718,606 | A | | 2/1998 | Rigby et al. |
| 5,743,765 | A | | 4/1998 | Andrews et al. |
| 5,766,043 | A | | 6/1998 | Talend |
| RE36,065 | E | | 1/1999 | Andrews et al. |
| 5,895,292 | A | | 4/1999 | Affeltranger |
| 6,077,122 | A | | 6/2000 | Elkhatib et al. |

OTHER PUBLICATIONS

Leder, System I/O, Electrical Working Group, "Connector Request for Information," Compaq Computer Corporation, Version 1.0, Oct. 5, 1999, pp. 1–6.

* cited by examiner

*Primary Examiner*—Brian Sircus
*Assistant Examiner*—Son V. Nguyen
(74) *Attorney, Agent, or Firm*—Hoffmann & Baron, LLP

(57) ABSTRACT

A printed circuit board connector includes an elongate electrical housing defining a plurality of bounded compartments. An insulative support member includes support elements individually resident within the bounded compartments. A pair of elongate electrical contacts are supported by each of the support elements. The contacts include solder tails at one end for termination to the printed circuit board and interconnection portions at the other end for mating electrical connection. The interconnection portions of the contacts are resident within the bounded compartments for establishing electrically shielded isolation therebetween. The conductive housing extends in bounded registry about the contact solder tails for establishing shielding from external electrical interferences.

6 Claims, 6 Drawing Sheets

HIGH-DENSITY HIGH-SPEED INPUT/ OUTPUT CONNECTOR

This application claims priority to U.S. provisional application Ser. No. 60/160,442, filed Oct. 19, 1999.

FIELD OF THE INVENTION

The present invention relates generally to improvements in electrical input/output (I/O) connectors. More particularly, the present invention relates to printed circuit board connectors with improved connector shielding.

BACKGROUND OF THE INVENTION

In the field of signal transmission technology, electrical signals are being transmitted at ever increasing speeds. Along with the desire to transmit information at faster rates, the industry has also seen the need to reduce the size of hardware employed so as to occupy less component space. In order to keep pace with these improvements, the interconnection technology, has also undergone significant changes.

Continued improvement in connection technology is not without problems. When decreasing the size of electrical connectors while requiring the connectors to transmit signals at higher rates, shielding between adjacent conductive components of the connector becomes a factor which must be addressed. Additionally, as these components are normally used in close proximity to other electronic components, the individual connector components must also be shielded from electromagnetic interferences and radio-frequency interferences. These interferences can adversely affect the performance levels of the connectors.

In the field of cable terminations, compact electrical connectors are known which provide for the termination of discrete insulated conductors of a multi-conductor cable. These connectors typically include an insulative connector housing supporting a plurality of electrical contacts having insulation displacing contact portions. These connectors also feature an internal contact shield to shield individual contact pairs from adjacent contact pairs. The shield is a die cast metallic member having horizontal and vertical walls which intersect perpendicularly in "cross" configurations to provide horizontal and vertical shielding of the contacts. The contact shield disclosed in these patents also includes an extended ground element for electrical engagement with the multi-conductor cable to maintain electrical ground continuity between the cable and the contact shield. Such a connector is shown and disclosed in U.S. Pat. No. 6,077,122, issued Jun. 22, 2000, entitled "Electrical Connector Having An Improved Connector Shield And a Multi-Purpose Strain Relief" and is incorporated by reference herein for all purposes.

While adequately providing for enhanced shielding between electrical components of a cable connector, the connector art has not successfully provided both internal shielding and external shielding in an input/output printed circuit board environment.

SUMMARY OF THE INVENTION

It is therefore an object of the present invention to provide an improved electrical connector which permits connection of a printed circuit while maintaining electrical shielding as between multiple pairs of contacts within the connector.

It is a further object of the present invention to provide an electrical connector for a printed circuit board where multiple pairs of the contacts are shielded from external interferences such as EMI and RFI.

In the efficient attainment of these and other objects, the present invention provides a printed circuit board connector. The connector includes an elongate conductive housing having a printed circuit board mounting surface and an interconnection surface. The conductive housing defines a plurality of bounded compartments adjacent the interconnection surface. An insulative support member is provided having individual support elements resident within the bounded compartments of the conductive housing. A pair of elongate electrical contacts are supported by each of the support elements. Each contact includes a solder tail at one end for termination to the printed circuit board and an interconnection portion at the other end for mating electrical connection. The interconnection portions are resident within the bounded compartments for establishing electrical shielded isolation between the interconnection portions of the adjacent pairs of contacts. The printed circuit board mounting surface of the conductive housing extends in bounded registry about the contact solder tails for establishing electrical shielding from external electrical interferences.

In a preferred embodiment of the present invention, the bounded compartments of the conductive housing extend from the interconnection surface of the housing to the printed circuit board surface for establishing electrically shielded isolation between adjacent pairs of contacts along the length thereof. The present invention may be practiced in either a straight through connector or a right angle connector.

DETAILED DESCRIPTION OF THE PREFERRED EMBODIMENT

The present invention provides a pair of mating connectors for electrically interconnecting a pair of printed circuit boards. The interconnected assembly provides shielding as between the conductive components of the connectors as well as provides shielding from external electrical interferences such as electromagnetic interferences (EMI) and radio-frequency interferences (RFI).

Figure 1:
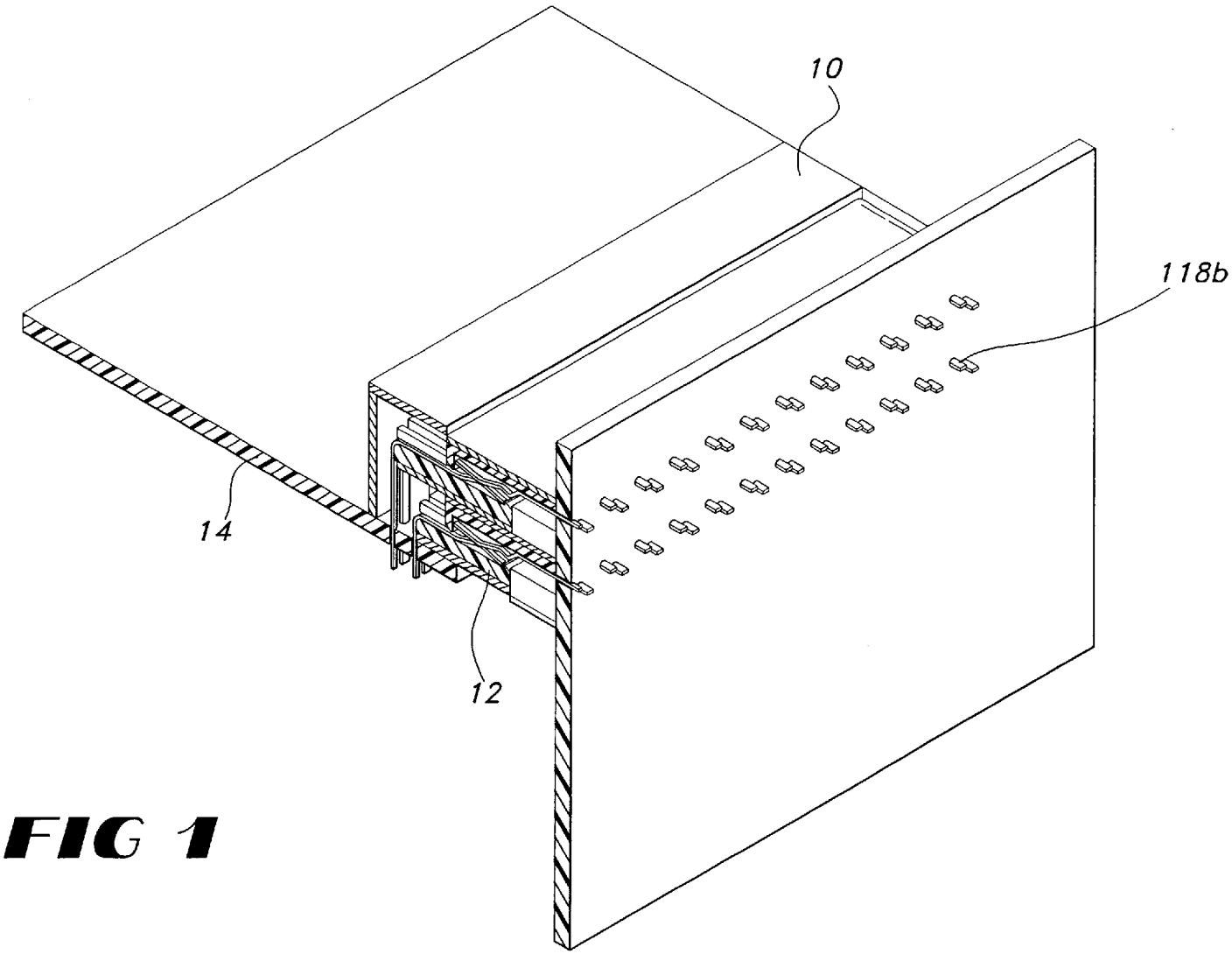
FIG. 1 is a perspective showing, partially in section, of a pair of mating connectors of the present invention interconnecting a pair of printed circuit boards at right angles.
Figure 3:
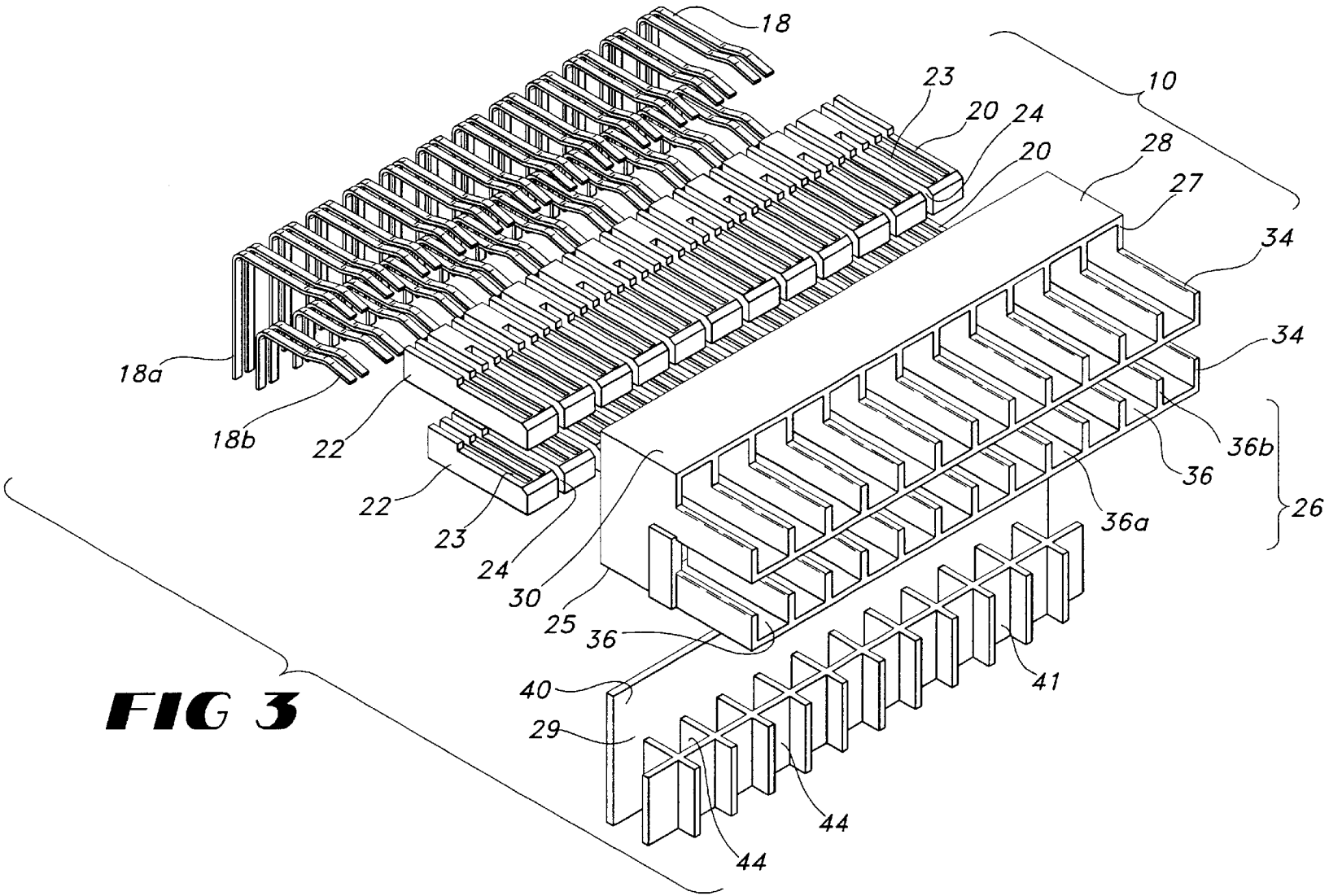
FIGS. 3 and 4 show respectively front and rear exploded perspective views of one connector of the assembly of FIG. 1.
Figure 4:
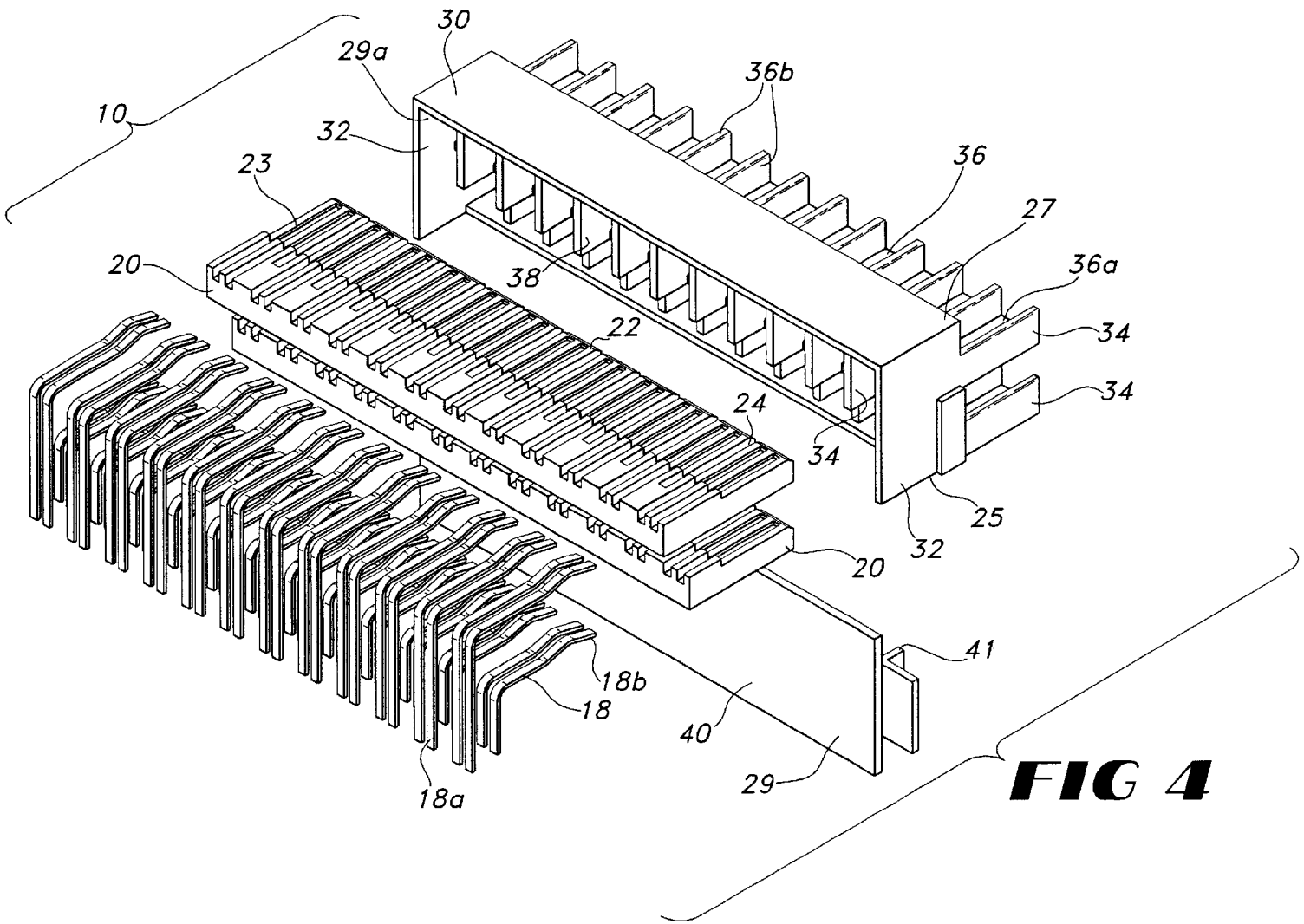
Figure 5:
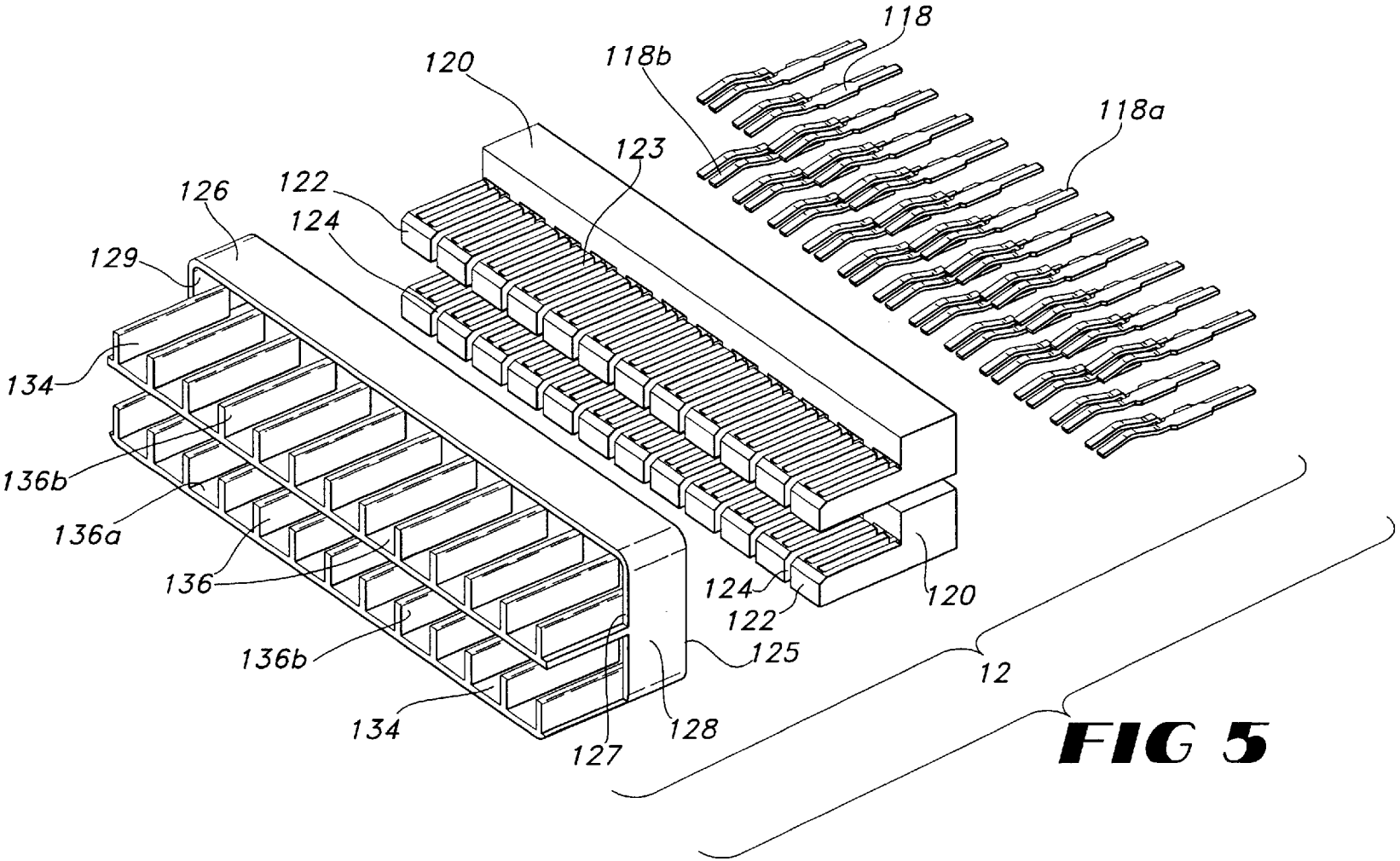
FIGS. 5 and 6 show respectively front and rear exploded perspective views of the other connector of the assembly of FIG. 1.
Figure 6:
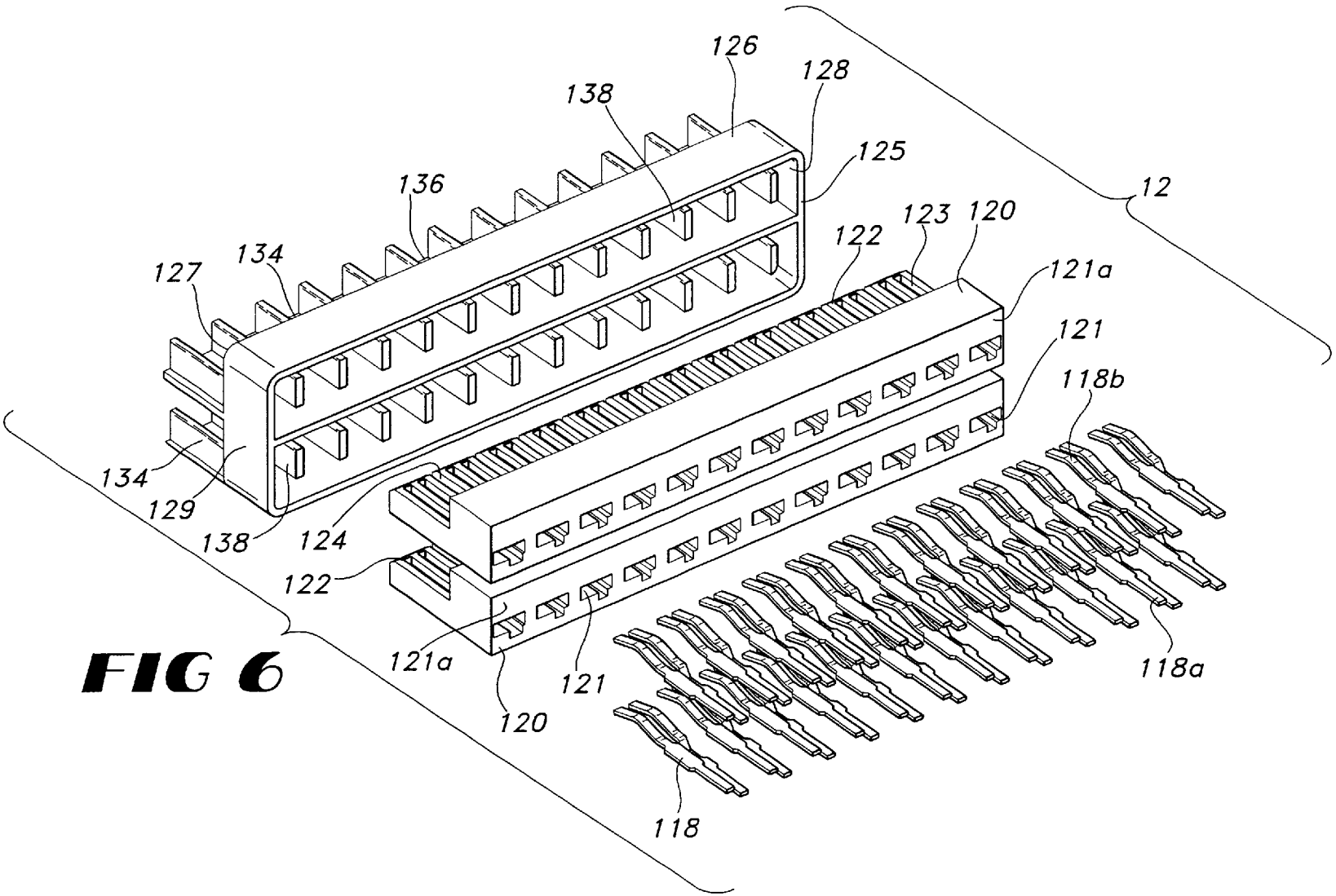

Referring to FIG. 1, a first electrical connector 10 is shown in mating interconnection with a second electrical connector 12. First connector 10 is mounted to a printed circuit board 14 while second electrical connector 12 is mounted to another printed circuit board 16. The printed circuit boards may be arranged as mother/daughter boards. The first electrical connector 10, which is more fully shown in FIGS. 3 and 4, is commonly referred to as right-angle connector in that connector 10 is mounted to the printed circuit board 14 to permit interconnection at a right angle with respect thereto. Second connector 12, more fully shown in FIGS. 5 and 6, is referred to as a straight-through connector in that printed circuit board 16 is mounted thereto in a fashion which permits interconnection in a direction perpendicular to the printed circuit board. It may be appreciated that while connectors 10 and 12 are shown as right-angle and straight-through connectors, respectively, the type of connector employed is dictated by the desired arrangement of the printed circuit boards and any combination of the connectors shown herein may be used in accordance with the present invention.

Referring more specifically to FIGS. 3 and 4, first connector 10 includes a plurality of electrical contacts 18. Contacts 18 are formed of conductive material and are shown in a plurality of pairs in two vertically spaced rows. Each contact 18 includes a solder tail 18*a* at one end for electrical engagement with plated through holes of printed circuit board 14 and a deflectable cantilevered spring contact portion 18*b* at the opposite end for mating electrical engagement of a like contact of second connector 12. Solder tail 18*a* and contact spring portion 18*b* are arranged at a right angle with respect to one another.

Connector 10 further includes a pair of contact support members 20. The contact support members 20 are typically formed of electrically insulative material and are shown in a vertically spaced apart manner so as to support the rows of contacts 18 in the same vertically spaced fashion. Each support member 20 includes a plurality of longitudinally extending support elements 22 spaced apart by slots 24 extending therebetween. Each support element 22 includes a pair of spaced apart side-by-side cavities 23 for supporting therein the contact spring portions 18*b* of contacts 18. The contacts 18 are arranged in support elements 22 such that the contacts are maintained in pairs, each pair being separated by slot 24. Contact support members 20 serve to support and maintain the individual contacts 18 in electrical isolation from one another.

First connector 10 further includes a two-part shield 26 which accommodates support members 20 and contacts 18 supported therein. Shield 26 which is formed electrically conductive die cast metal includes a housing 28 and a cover 29.

Housing 28 is a generally rectangular member having an upper surface 30 and a pair of depending side surfaces 32. Housing 28 defines a printed circuit board mounting surface 25 and an interconnection surface 27, which in the present example are arranged orthogonally to each other. Housing 28 further includes a pair of vertically spaced conductive platforms 34 extending outwardly from interconnection surface 27. Conductive platforms 34 define a plurality of bounded conductive compartments 36 which accommodate individually support elements 22 of support members 20. In that regard, compartments 36 each include a bottom wall 36*a* and a pair spaced apart upwardly extending side walls 36*b*. Laterally adjacent compartments 36 are further separated by conductive extensions 38, as particularly shown in FIG. 4, which extend rearwardly from compartments 36.

Shield 26 further includes a cover 29 which is attachable to the open rear portion 29*a* of housing 28. Cover 29 includes a planar back wall 40 and a grid-like member 41 having a cross-shaped partitions 42 supported thereby. Cross-shaped partitions 42 define a plurality of bounded chambers 44 which, when assembled to housing 28, form bounded extensions of bounded compartments 36.

First connector 10 is assembled by inserting the contacts 18 in support members 20 such that contact spring portions 18*b* reside within the cavities 23 of individual platform elements 22. Support members 20 are then inserted into housing 28 such that each individual support element 22 resides within an individual compartment 36. Cover 29 is then attached to housing 28 such that each pair of solder tails 18*b* reside in isolated fashion within chambers 44 formed by the cross-shaped partitions 42. As assembled, each pair of contacts 18 is electrically shielded from an adjacent pair by virtue of residence of contact spring portions 18*b* within compartment 36 and positioning of solder tails 18*a* within chambers 44 formed by cross-shaped partitions 42. Electrical shielded continuity is maintained across connector 10 as connector housing 28 is integrally formed and mechanically and electrically attached to cover 29. This arrangement isolates the contacts 18 from external electrical influences such as EMI and RFI.

Figure 2:
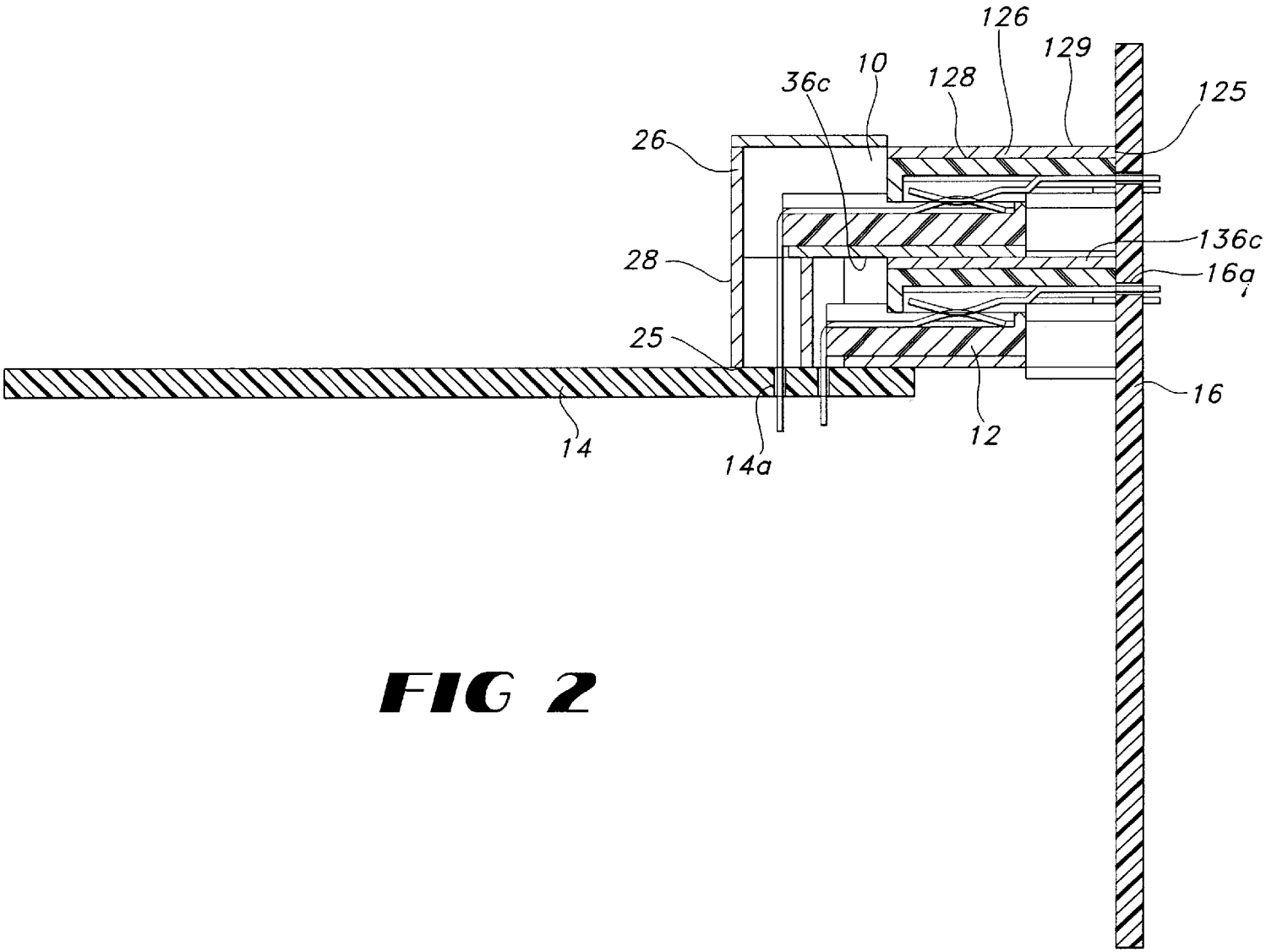
FIG. 2 is a sectional showing of the interconnected assembly of FIG. 1.

Further, such continuance of electrical continuity is maintained to the surface of the printed circuit board 14 as shown in FIGS. 1 and 2 by the mounting of first connector 10 to the surface of the printed circuit board. With the mounting surface 25 positioned against printed circuit board 14, the housing 28 extends in bounded registry about the contact solder tails 18*b*, so as to surround and enclose the solder tails providing shielding from electrical interferences.

Referring now more specifically to FIGS. 5 and 6, second connector 12 includes a plurality of electrical contacts 118. Contacts 118 are formed of conductive material and are shown in a plurality of pairs of vertically spaced rows. Each contact 118 includes a solder tail 118*a* at one end for electrical engagement with plated through holes of printed circuit board 16 and a deflectable cantilevered spring contact portion 118*b* at the opposite end for mating electrical engagement with contact 18 of first connector 10. Solder tail 118*a* and spring contact portion 118*b* are arranged in line in oppositely extending fashion.

Connector 12 further includes a pair of contact support members 120. Contact support members 120 are typically formed of insulative material and are shown in a vertically spaced apart manner so as to support the rows of contacts 118 in the same vertically spaced fashion. Each support member 120 includes a plurality of longitudinally extending support elements 122 spaced apart by slots 124 extending therebetween. Each support element 122 includes a pair of spaced apart side-by-side cavities 123 for supporting therein the contact spring portions 118*b* of contacts 118. The cavities 123 are insertably accessible by openings 121 through a rear wall 121*a* of each support member 120. The contacts 118 are arranged in support elements 122 such that the contacts are maintained in pairs, each pair being separated by slot 124. Contact support members 120 serve to support and maintain the individual contacts 118 in electrical isolation from one another.

Second connector 12 further includes a conductive shield 126 which accommodates support members 120 and contacts 118 supported therein. Shield 126 which is formed of electrically conductive die cast metal is defined by an elongate housing 128 which is generally rectangular. Housing 128 includes a perimetrical body 129 which defines at one end a printed circuit board mounting surface 125 and at the other end an interconnection surface 127. Housing 128 further includes a pair of vertically spaced conductive platforms 134 extending outwardly from interconnection surface 127. Conductive platforms 134 define a plurality of bounded compartments 136 which accommodate individually support elements 122 of support members 120. In that regard, compartments 136 each include a bottom wall 136*a* and pair of spaced apart upwardly extending side walls 136*b*. Laterally adjacent compartments 136 are further separated by conductive extensions 138 as particularly shown in FIG. 6 which extend rearwardly from compartments 136 toward printed circuit board mounting surface 125.

The second connector 12 is assembled by inserting contacts 118 in support members 120 through openings 121 such that the contact spring portions 118 reside within cavities 125 of individual support elements 122. Support members 120 are then inserted into housing 128 such that each support element 122 resides within an individual compartment 136. As assembled, each pair of contacts 118 is electrically shielded from an adjacent pair by virtue of residence of the contact spring portions 118*b* within compartments 136 and the positioning of solder tails 118*a* within body 129 and between extensions 138. Electrical shielded continuity is maintained across connector 12 as connector housing 128 is integrally formed. This arrangement isolates contacts 118 from external electrical influences such as EMI and RFI.

Further, such continuance of electrical continuity is maintained at the surface of printed circuit board 16 as shown in FIGS. 1 and 2 by the mounting of second connector 12 to the surface of the printed circuit board. With the mounting surface 125 positioned against printed circuit board 16, the body 129 of housing 128 extends in bounded registry about the contact solder tails 118 so as to surround and enclose the solder tails providing shielding from external electrical interferences.

Having described the electrical connectors of the present invention, the electrical connection of two printed circuit boards employing such connectors may now be described with reference to FIGS. 1 and 2.

With connector 12 assembled as described, the connector may be mounted to printed circuit board 16. The solder tails 118*b* of contacts 118 are inserted through plated through holes 16*a* of board 16 where they may be soldered thereto in conventional fashion. This secures connector 12 to printed circuit board 16. Also, as conductive shield 126 surrounds contacts 118 and printed circuit board mounting face 125 is contact with printed circuit board 16, the conductive shield 126 may be placed in electrical connection with a ground trace on printed circuit board 16 so as to maintain the shield 26 at ground potential.

In similar fashion, connector 10 assembled as described above maybe secured to printed circuit board 14 by the insertion of contact tails 18*b* to contacts 18 into plated through holes 14*a* thereof. Similarly, conductive shield 26 of connector 12 may be placed in electrical engagement with a ground trace on the surface of printed circuit board 14 by placing the ground trace in electrical contact with the printed circuit board mounting face 25 thereof. The present invention further contemplates the use of mounting posts (not shown) on shields 26, 126 for solder engagement with the ground traces on the respective printed circuit boards. As connector 12 is a straight through connector and connector 10 is a right angle connector, interconnection of the two connectors will result in printed circuit boards 14 and 16 being placed at right angles with respect to one another.

The connectors including the circuit boards secured thereto may be connected in conventional fashion. The contacts 18 and 118 of the respective connectors, as well as the support members 20 and 120 and conductive platforms 34 and 134 are designed in a hermaphroditic like manner so that mating interconnection can be achieved. The deflectable cantilevered spring contact portions 18*b* and 118*b* of the respective connectors are placed in engagement to establish electrical continuity therebetween. Similarly, upon connection of connector 10 to connector 12, the conductive platforms 34 and 134 will be placed in electrical engagement. This is particularly shown in FIG. 2 where undersurfaces 36*c*, 136*c* of bottom walls 36*a*, 136*a* are placed in sliding engagement upon interconnection of connector 10 with connector 12. This establishes and maintains ground continuity between the respective electrical connectors.

Various changes to the foregoing described and shown structures would now be evident to those skilled in the art. Accordingly, the particularly disclosed scope of the invention is set forth in the following claims.

What is claimed is:

1. An electrical connector comprising:

a plurality of elongate electrical contacts, each contact including an interconnection portion and an opposed termination portion;

an elongate insulative support member having plural longitudinally spaced apart support elements, each support element supporting at least one of said plurality of electrical contacts, and an elongate conductive shield for enclosing said support member, said shield including a housing having a conductive platform defining a plurality of bounded compartments which individually accommodate said spaced apart support elements; and a cover overlying said housing, said cover including a planar wall and a partition member extending from said wall, said partition member extending between said spaced apart support elements to define with said bounded compartments of said housing and to form a plurality of shielded chambers about said contacts.

2. An electrical connector of claim 1 further including a pair of said support members arranged in vertically spaced orientation.

3. An electrical connector of claim 2 wherein said cover includes a grid-like pattern defining said partition member, said grid-like pattern defining longitudinally and vertically spaced chambers.

4. An electrical connector of claim 3 wherein said housing of said conductive shield includes an open rear portion for insertable accommodation of said pair of said support members, said cover being attachable to said housing with said partition member being inserted into said housing and said planar wall covering said open rear portion.

5. An electrical connector of claim 1 wherein said contact termination portion includes solder tails extending from said housing.

6. An electrical connector of claim 5 wherein said contact solder tails are depending at a right angle with respect to interconnection portions.

* * * * *

UNITED STATES PATENT AND TRADEMARK OFFICE

CERTIFICATE OF CORRECTION

PATENT NO. : 6,375,506 B1 
DATED : April 23, 2002
INVENTOR(S) : Saunders et al.

It is certified that error appears in the above-identified patent and that said Letters Patent is hereby corrected as shown below:

Column 1,
Line 50, reads "...Jun. 22, 2000…" should read -- ...Jun. 20, 2000… --.

Column 5,
Line 45, reads "...above maybe…" should read -- ...above may be… --.

Column 6,
Line 37, reads "...define with said…" should read -- ...define said… --.

Signed and Sealed this

Fourteenth Day of January, 2003

JAMES E. ROGAN
*Director of the United States Patent and Trademark Office*